US007315290B2

(12) United States Patent
Harada et al.

(10) Patent No.: US 7,315,290 B2
(45) Date of Patent: Jan. 1, 2008

(54) DATA COMMUNICATION APPARATUS

(75) Inventors: Setsuo Harada, Kanagawa (JP); Tadashi Ezaki, Tokyo (JP)

(73) Assignee: Sony Corporation, Tokyo (JP)

( * ) Notice: Subject to any disclaimer, the term of this patent is extended or adjusted under 35 U.S.C. 154(b) by 21 days.

(21) Appl. No.: 10/562,928

(22) PCT Filed: Jun. 25, 2004

(86) PCT No.: PCT/JP2004/009021

§ 371 (c)(1),
(2), (4) Date: Dec. 30, 2005

(87) PCT Pub. No.: WO2005/002081

PCT Pub. Date: Jan. 6, 2005

(65) Prior Publication Data

US 2006/0192723 A1 Aug. 31, 2006

(30) Foreign Application Priority Data

Jun. 30, 2003 (JP) ..... 2003-188462

(51) Int. Cl.
*H01Q 7/00* (2006.01)

(52) U.S. Cl. ..... 343/866; 343/702

(58) Field of Classification Search ..... 343/700 MS, 343/702, 741, 866

See application file for complete search history.

(56) References Cited

U.S. PATENT DOCUMENTS 5,451,965 A * 9/1995 Matsumoto ..... 343/702
6,011,519 A * 1/2000 Sadler et al. ..... 343/742
6,442,399 B1 * 8/2002 Tsuru et al. ..... 455/575.7
7,050,007 B2 * 5/2006 Akiho et al. ..... 343/702
2002/0084938 A1 7/2002 Kim
2002/0183094 A1 12/2002 Seita
2002/0190906 A1 * 12/2002 Kim et al. ..... 343/702
2004/0095283 A1 * 5/2004 Park et al. ..... 343/702
2004/0198428 A1 * 10/2004 Hong et al. ..... 455/556.1

FOREIGN PATENT DOCUMENTS

| | | |
|---|---|---|
| EP | 1 308 886 A2 | 5/2003 |
| FR | 2 724 274 | 3/1996 |
| GB | 2 385 991 | 8/2001 |
| JP | 8-268536 | 10/1996 |
| JP | 2000-242755 | 9/2000 |
| JP | 2000-278170 | 10/2000 |

(Continued)

OTHER PUBLICATIONS

European Search Report mailed by the European Patent Office on Jul. 3, 2007 for counterpart European Application No. 04746490.4 (3 pages).

*Primary Examiner*—Tan Ho
(74) *Attorney, Agent, or Firm*—Finnegan, Henderson, Farabow, Garrett & Dunner, L.L.P.

(57) ABSTRACT

Disclosed is a data communication apparatus for non-contact data communication using electromagnetic induction. At least a portion of a conductor 5*a* of the loop coil antenna (5) of the data communication apparatus, adapted for non-contact data communication, exploiting electromagnetic induction, is arranged for extending along the lateral side of an enclosure (2*a*) for equalizing the sensitivity of the loop coil antenna (5) across both major surfaces of the enclosure (2*a*).

10 Claims, 7 Drawing Sheets

FOREIGN PATENT DOCUMENTS

| | | |
|---|---|---|
| JP | 2002-236901 | 8/2002 |
| JP | 2002-342720 | 11/2002 |
| JP | 2003-37861 | 2/2003 |
| JP | 2003-60748 | 2/2003 |
| JP | 2003-150916 | 5/2003 |

* cited by examiner

DATA COMMUNICATION APPARATUS

This application is a 371 of PCT/JP04/09021 filed on Jun. 25, 2004.

TECHNICAL FIELD

This invention relates to a data communication apparatus for non-contact data communication exploiting electromagnetic induction. This application claims priority of Japanese Patent Application No. 2003-188462, filed in Japan on Jun. 30, 2003, the entirety of which is incorporated by reference herein.

BACKGROUND ART

Recently, in the field of automatic ticket checkers or electronic money systems, a non-contact IC card is in use. This non-contact IC card includes, within the bulk of the card, an IC (integrated circuit) chip, composed of various electronic circuits, adapted for performing various processing operations for data write/readout, and a loop coil antenna, composed of a conductor wound in a flat configuration. The non-contact IC card exploits the a.c. voltage, induced in a loop coil antenna provided to the non-contact IC card, under an a.c. magnetic field of, for example, 13.56 MHz, generated in the loop coil antenna provided to a reader/writer adapted to write or read out data for the non-contact IC card, on the basis of the principle of electromagnetic induction, as a power supply for actuating an IC chip. Moreover, the non-contact IC card has non-contact data communication with the reader/writer by changing the load impedance.

Thus, with the present non-contact IC card, in which the power as needed is supplied from the reader/writer, there is no necessity of providing an internal power supply, such that the data write/readout operation may be carried out with ease speedily, simply by momentarily holding the card over the reader/writer.

Meanwhile, in view of user-friendliness of the non-contact IC card, it is now being contemplated to have the above-described non-contact IC card mounted on e.g. a portable device, such as a cellular phone, so that the portable device itself may serve as the non-contact device for wireless near-distance transmission, without the necessity for a user to carry about the card, as disclosed in the Japanese laid-Open Patent publication 11-213111.

However, if, with the above-described data communication apparatus, the planar loop coil antenna 101, mounted on the non-contact IC card, is arranged in an enclosure 100 of a veritable thickness, such as the cellular phone schematically shown in FIG. 7, sensitivity offset occurs across one of the major surfaces of the enclosure 100, in which the loop coil antenna 101 is arranged, and the other major surface, thus deteriorating the user friendliness. That is, if the planar loop coil antenna 101 is arranged within the inside of the enclosure 100, having the veritable thickness, such a problem is raised in which the sensitivity of the loop coil antenna 101 is changed with the orientation or the sensitivity area becomes smaller in size.

Thus, for equalizing the sensitivity of the loop coil antenna 101 across both major surfaces of the loop coil antenna 101, the planar loop coil antenna 101 must be arranged centrally in the enclosure 100. However, if, with the portable device, such as the aforementioned cellular phone, this planar loop coil antenna is arranged centrally in the enclosure, there is imposed significant mounting constraint.

Moreover, if, with the above-described loop coil antenna 101, the number of turns of the conductor is increased, the opening area of the loop coil antenna is decreased, thus narrowing down the area of sensitivity of communication with the reader/writer.

DISCLOSURE OF THE INVENTION

It is an object of the present invention to provide a data communication apparatus whereby it is possible to resolve the aforementioned problems inherent in the prior art.

It is another object of the present invention to provide a non-contact data communication apparatus in which the sensitivity of the loop coil antenna is equalized on both major surfaces of the enclosure, regardless of the thickness of the enclosure, and in which it is possible to enlarge the sensitivity area.

A data communication apparatus according to the present invention includes an enclosure, a mobile phone function unit arranged within said enclosure, a loop coil antenna arranged so that at least a portion of a conductor extends along lateral surfaces, which are surfaces forming said enclosure with the exclusion of both major surfaces of the enclosure, and a semiconductor integrated circuit connected to said loop coil antenna, said semiconductor integrated circuit carrying out non-contact data communication over said loop coil antenna with an exterior communication device with use of electromagnetic induction, and having the function of a non-contact IC card and/or a reader/writer function.

EFFECT OF THE INVENTION

With the data communication apparatus, described above, in which the loop coil antenna is arranged with its conductor extending along the lateral side of the enclosure, the sensitivity of the loop coil antenna may be equalized in a direction along the thickness of the enclosure, thereby enlarging the area of communication sensitivity of the loop coil antenna.

Other objects and specified advantages of the present invention will become more apparent from the following explanation especially when read in conjunction with the drawings.

BEST MODE FOR CARRYING OUT THE INVENTION

Figure 1:
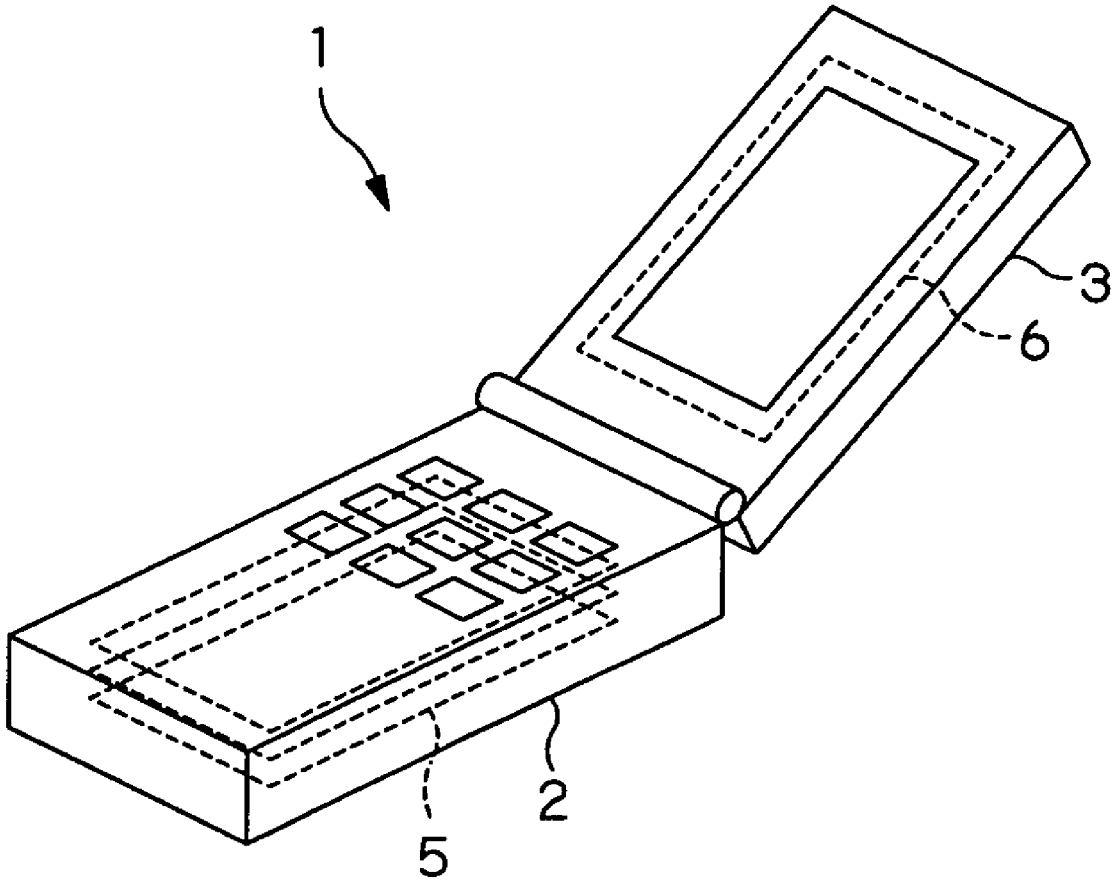
FIG. 1 is a schematic perspective view showing the structure of a cellular phone embodying the present invention.

Referring now to the drawings, a data communication apparatus according to the present invention is explained in detail.

The data communication apparatus, embodying the present invention, is a cellular phone 1, having a non-contact IC card function and a reader/writer function, in addition to the conventional phone function, as shown for example in FIG. 1. This cellular phone 1 is of such a structure having a display part 3 mounted for opening/closure to a main body part 2.

Figure 2:
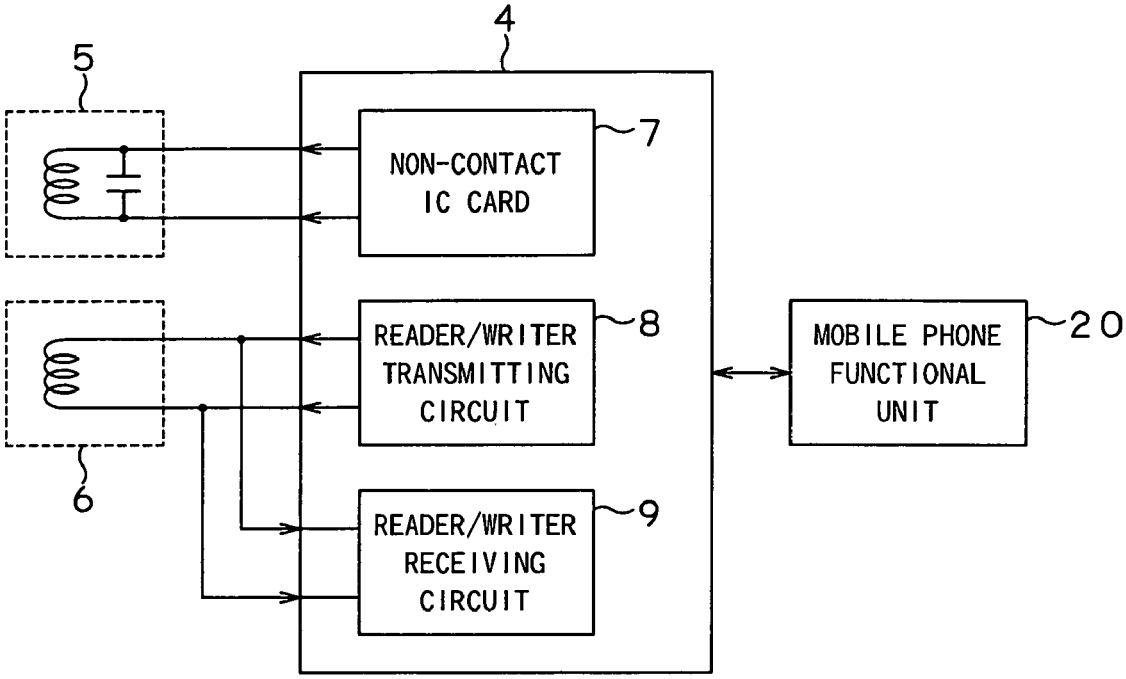
FIG. 2 is a block diagram showing the structure of a semiconductor integrated circuit built into the cellular phone.

Referring to FIGS. 1 and 2, a semiconductor integrated circuit 4 (IC), having a non-contact IC card function and a reader/writer function, a loop coil antenna 5 on the non-contact card side, and a loop coil antenna 6 on the reader/writer side, are built in the cellular phone 1. The loop coil antennas 5, 6 are electrically connected to the semiconductor integrated circuit 4. Of these, the loop coil antenna 5 of the non-contact card side is arranged in an enclosure of the main body part 2, while the loop coil antenna 6 of the reader/writer side is arranged in an enclosure of the display part 3.

The semiconductor integrated circuit 4 includes a non-contact IC card 7, for which data is written and read out by an exterior reader/writer, not shown, a reader/writer transmitting circuit 8 for writing data on an exterior non-contact IC card, and a reader/writer receiving circuit 9 for reading out data from the exterior non-contact IC card. To this semiconductor integrated circuit 4, there is also electrically connected a cellular phone function unit 20 for implementing the call or communication function of the cellular phone 1.

On receipt of an electromagnetic wave, as a query signal, sent out via loop coil antenna 6 on the reader/writer side, over the loop coil antenna 5, the non-contact IC card 7 rectifies the carrier of the electromagnetic wave to convert it into a d.c. supply power, which drives an internal circuit, not shown. The non-contact IC card 7 also executes amplitude modulation, as the IC card changes the load between it and the exterior reader/writer side loop coil antenna, responsive to the query signal, to send a reply signal through the loop coil antenna 6 to the exterior reader/writer.

The reader/writer transmitting circuit 8 modulates the carrier for transmission, responsive to data for transmission, to send the query signal through the loop coil antenna 6 to the non-contact IC card. The reader/writer receiving circuit 9 receives a reply signal, sent from the exterior non-contact IC card, over the loop coil antenna 6, and demodulates the signal to acquire received data.

Figure 3:
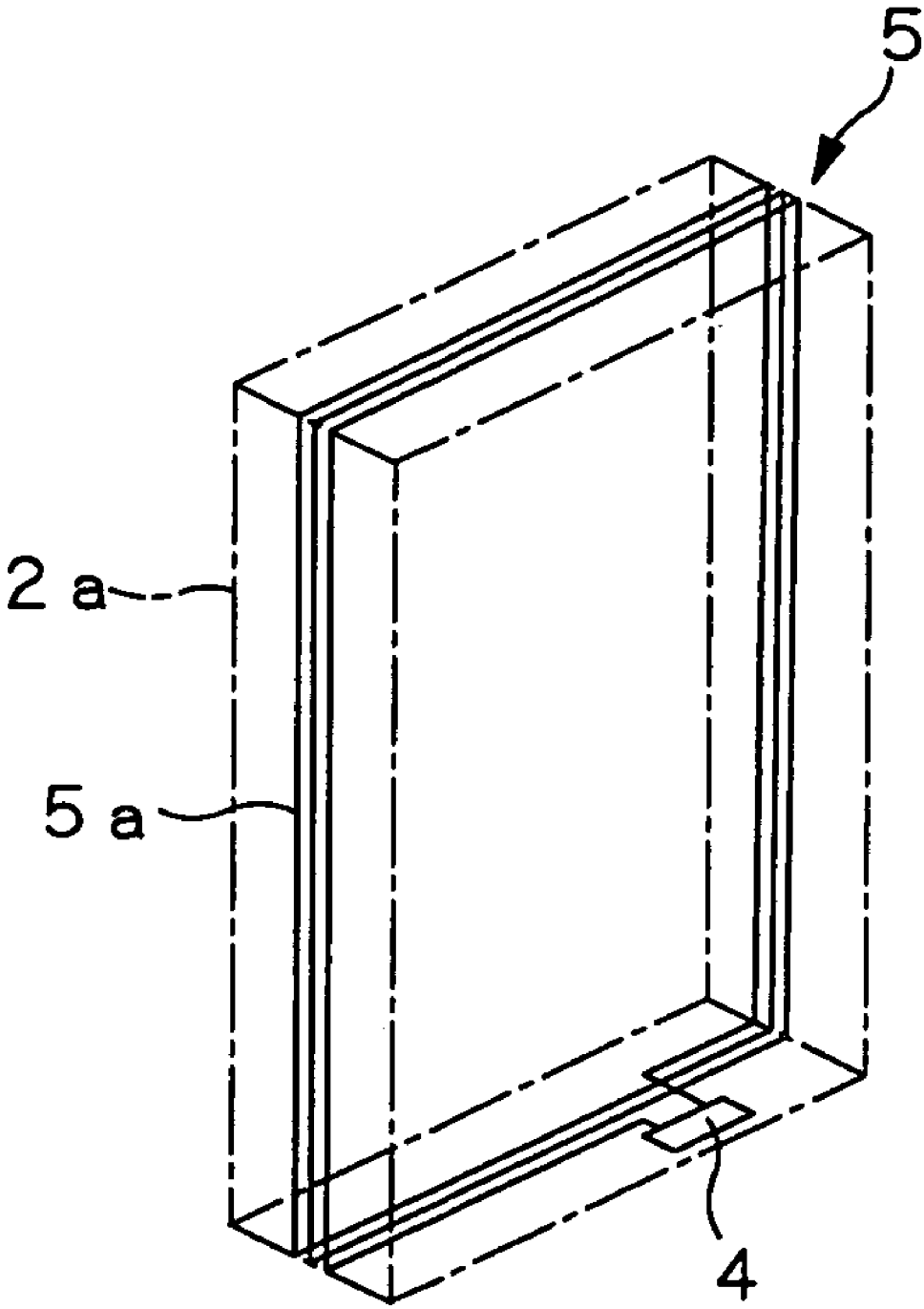
FIG. 3 is a perspective view showing the structure of a loop coil antenna arranged in the cellular phone.

The non-contact IC card side loop coil antenna 5 is arranged so that its conductor 5*a* extends along the entire inner peripheral surface of an enclosure 2*a* of the main body part 2, as shown in FIGS. 1 and 3. This enables the sensitivity of the loop coil antenna 5 to be equalized along the thickness of the enclosure 2*a*, without dependency on the thickness of the enclosure 2*a*.

Figure 7:
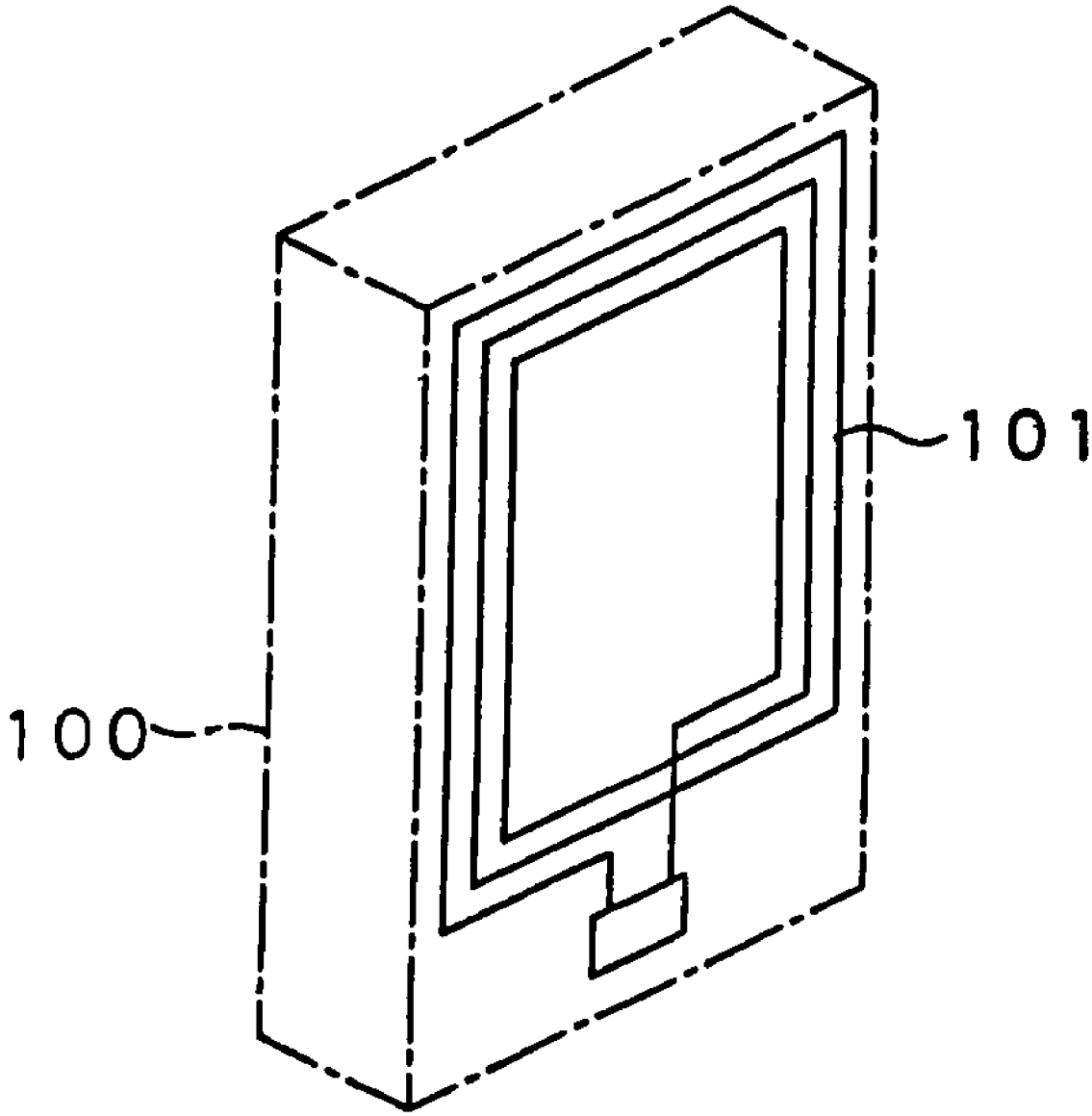
FIG.7 (PRIOR ART)
FIG. 7 is a perspective view showing the structure of a conventional loop coil antenna.

This loop coil antenna 5 has a three-dimensional shape by the conductor 5*a* being wound spirally along the inner lateral surface of the enclosure 2*a*. In this case, a large opening area of the loop coil antenna 5 may be provided without dependency on the number of turns of the winding of the conductor 5*a*, thus appreciably enlarging the area of sensitivity for communication with the reader/writer, as compared to a conventional loop coil antenna 101 shown in FIG. 7.

Figure 4:
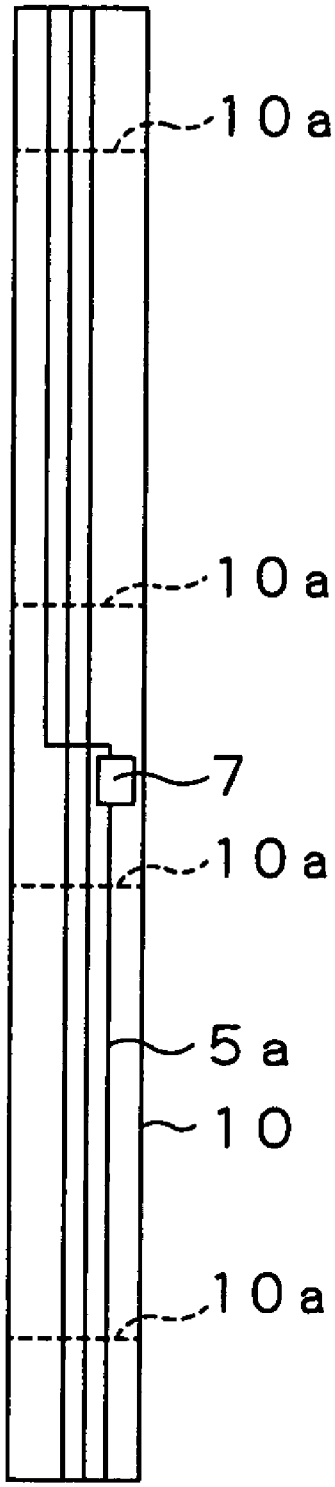
FIG. 4 is a plan view showing the structure of the loop coil antenna and a flexible printed circuit board.
Figure 5:
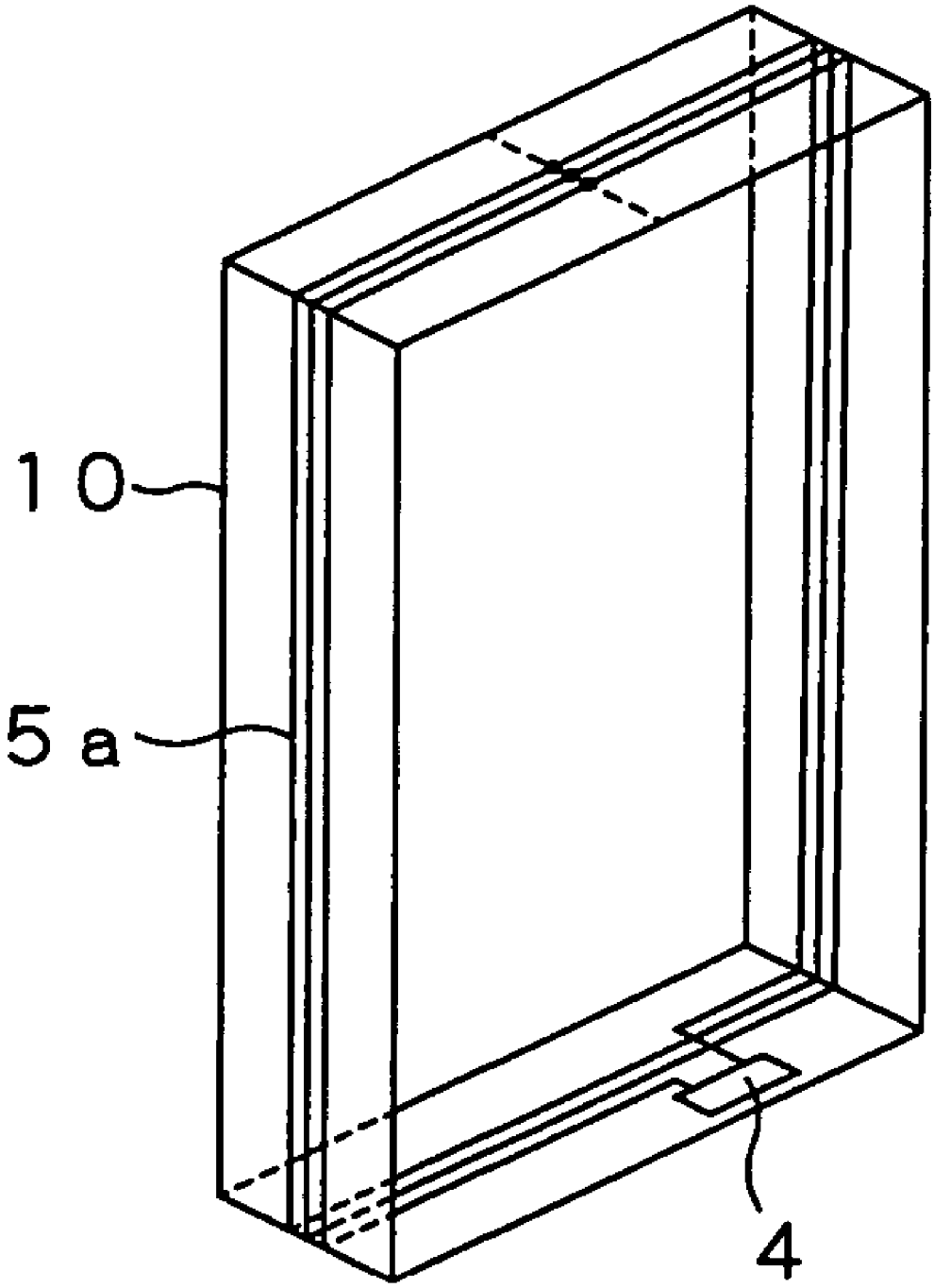
FIG. 5 is a perspective view showing the state in which the loop coil antenna is formed by the flexible printed circuit board.

The loop coil antenna 5, having this three-dimensional shape, may readily be produced using a flexible printed circuit board shown in FIG. 4. Specifically, the flexible printed circuit board 10 is a flexible elongated insulating substrate or film of, for example, polyimide. The conductor 5*a* is formed on the major surface of the flexible printed circuit board 10 as a plural number of linear copper foil patterns arrayed in a direction perpendicular to the longitudinal direction of the substrate. This flexible printed circuit board 10 includes plural folding lines 10*a* in keeping with the corners of the inner lateral surface of the enclosure 2*a*. The forming positions of the folding lines 10*a* are optional.

This flexible printed circuit board 10 is bent along the folding lines 10*a* in the same direction and the longitudinal ends thereof are bonded together to form the flexible printed circuit board 10 in a tubular form. At this time, the one and the other ends of the neighboring patterns of the conductor 5*a* are severally interconnected to form a sole loop coil of the conductor wound spirally along the short side direction of the flexible printed circuit board 10. It is noted that both ends of the loop coil are electrically connected to the semiconductor integrated circuit 4 mounted on the flexible printed circuit board 10. The ends of the loop coil may also be connected to a substrate on which the semiconductor integrated circuit 4 is mounted e.g. by a wire.

The loop coil antenna 5, having the three-dimensional shape, may be produced extremely readily. This loop coil antenna 5 may readily be arranged along the lateral surface of the enclosure 2*a*. The loop coil antenna 5 is bonded to the lateral surface of the enclosure 2*a* using an adhesive or by plugging into a socket-like recess formed in the lateral surface of the enclosure 2*a*. The loop coil antenna 5 may also be secured by any other suitable methods as necessary.

Figure 6:
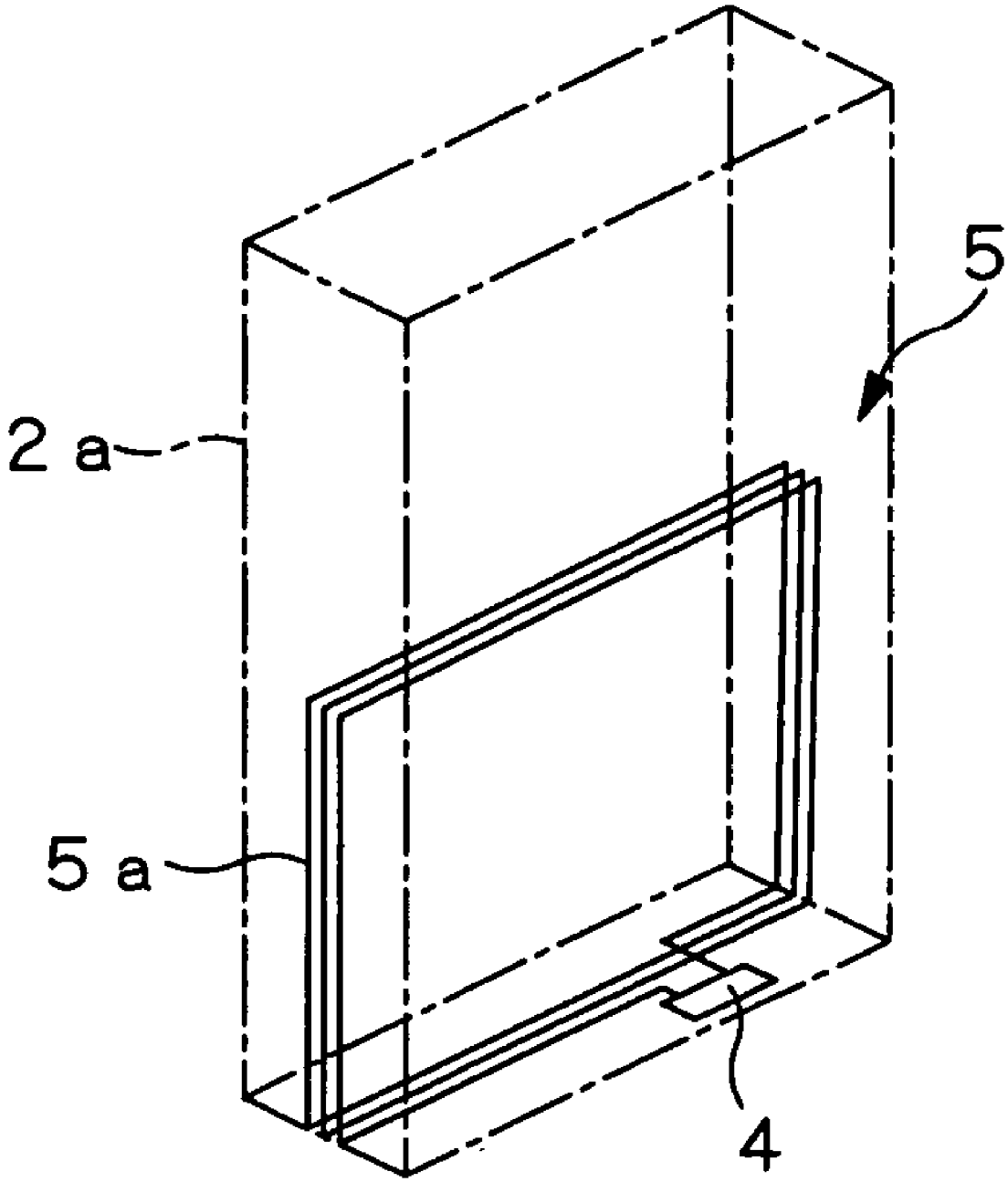
FIG. 6 is a perspective view showing a modified structure of a loop coil antenna arranged in the cellular phone.

Meanwhile, the loop coil antenna 5 may also be arranged so that, instead of the conductor 5*a* being arranged on the entire periphery of the enclosure 2*a*, the conductor 5*a* is laid along a fraction of the lateral surface of the enclosure 2*a*, as shown for example in FIG. 6*a*.

The loop coil antenna 5 may be directly embedded in the lateral surface of the enclosure 2*a* of resin. Alternatively, the conductor 5*a* may be plated on the lateral surface of the resin enclosure 2*a*, to a preset pattern, or the conductor 5*a* may be arranged in a groove formed in the lateral surface of the enclosure 2*a*.

In the cellular phone 1, described above, in which the non-contact IC card side loop coil antenna 5 is arranged for extending along the lateral surface of the enclosure 2*a* of the main body part 2, it is possible to provide for approximately equalized sensitivity of the loop coil antenna 5 along the thickness of the enclosure 2*a* on both major surfaces of the main body part 2 to enlarge the sensitivity area of communication of the cellular phone 1 with the exterior reader/writer. Thus, with the present cellular phone 1, it is possible to obtain the sensitivity of the loop coil antenna 5 which is substantially equalized across both major surfaces of the main body part 2, so that the sensitivity area for communication may be enlarged to improve user friendliness further.

With the cellular phone 1, described above, the conductor provided to the reader/writer side loop coil antenna 6 may also be of a three-dimensional shape, that is, may be arranged so that its conductor 5*a* extends along the lateral surface of the enclosure of the display part 3, as in the case of the non-contact IC card side loop coil antenna 5. Additionally, with the cellular phone 1, the non-contact IC card side loop coil antenna 5 and the reader/writer side loop coil antenna 6 may be provided to the enclosure of the display part 3 and to the enclosure 2*a* of the main body part 2, respectively. Furthermore, with the cellular phone 1, both of the loop coil antennas 5, 6 may be provided to the enclosure of the main body part 2 or to the enclosure of the display part 3.

The data communication apparatus of the present invention is not limited to the cellular phone 1 and may be broadly applied to a non-contact device for wireless near-distance transmission carrying the aforementioned IC card function and/or the reader/writer function.

It should be noted that the present invention is not limited to the above embodiment described in the foregoing with reference to the drawings and, as may be apparent to those skilled in the art, various changes, substitutions or equivalents may be envisaged without departing from the scope of the invention.

INDUSTRIAL APPLICABILITY

With the data communication apparatus, according to the present invention, it is possible to obtain substantially equalized sensitivity of the loop coil antenna on both major surfaces of the enclosure having a veritable thickness, such that the sensitivity area which allows for communication may be enlarged, thus further improving the user friendliness.

The invention claimed is:

1. A data communication apparatus comprising:

an enclosure;

a mobile phone function unit arranged in said enclosure;

a loop coil antenna arranged so that at least a portion of a conductor extends along the peripheral of lateral surfaces, said lateral surfaces forming said enclosure with the exclusion of both major surfaces of the enclosure; and a semiconductor integrated circuit connected to said loop coil antenna, said semiconductor integrated circuit carrying out non-contact data communication over said loop coil antenna with an exterior communication device by using electromagnetic induction and/or a reader writer function.

2. The data communication apparatus according to claim 1 wherein said conductor is arranged for extending along the entire periphery of said enclosure.

3. The data communication apparatus according to claim 1 wherein said loop coil antenna is of a three-dimensional shape, with said conductor being mounted for extending spirally along the lateral surfaces of said enclosure.

4. The data communication apparatus according to claim 3 wherein said loop coil antenna is formed by forming a plurality of patterned linear copper foils on a major surface of a flexible insulating substrate along a direction perpendicular to the longitudinal direction of said insulating substrate.

5. The data communication apparatus according to claim 1 wherein said loop coil antenna is formed by being embedded in a lateral surface of said enclosure.

6. The data communication apparatus according to claim 1 wherein said loop coil antenna is formed by a first loop coil antenna, electrically connected to a non-contact IC card circuit part, implementing the non-contact IC card function of said semiconductor integrated circuit, and a second loop coil antenna, electrically connected to a reader/writer circuit part, implementing the reader/writer function of said semiconductor integrated circuit, and wherein both of said first loop coil antenna and the second loop coil antenna are arranged on the lateral side of said enclosure.

7. The data communication apparatus according to claim 6 wherein said enclosure includes a main body part and a display part mounted for opening/closure relative to said main body part.

8. The data communication apparatus according to claim 7 wherein one of said first and second loop coil antennas is arranged in said main body part of said enclosure and the other of said first and second loop coil antennas is arranged in said display part thereof.

9. The data communication apparatus according to claim 7 wherein both of said first and second loop coil antennas are arranged in said main body part of said enclosure.

10. The data communication apparatus according to claim 7 wherein both of said first and second loop coil antennas are arranged in said display part of said enclosure.

* * * * *